US005479068A

United States Patent [19]

Muto

[11] Patent Number: 5,479,068

[45] Date of Patent: Dec. 26, 1995

[54] COLOR CATHODE RAY TUBE

[75] Inventor: Satoshi Muto, Mobara, Japan

[73] Assignee: Hitachi, Ltd., Tokyo, Japan

[21] Appl. No.: 205,635

[22] Filed: Mar. 4, 1994

[30] Foreign Application Priority Data

Mar. 8, 1993 [JP] Japan ..... 5-046843

[51] Int. Cl.[6] ..... H01J 29/10

[52] U.S. Cl. ..... 313/461; 313/462; 313/472

[58] Field of Search ..... 313/461, 462, 313/470, 472, 402, 403, 408; 348/805

[56] References Cited

U.S. PATENT DOCUMENTS

| | | | |
|---|---|---|---|
| 3,247,412 | 4/1966 | Barneveld et al. | 313/470 |
| 4,893,054 | 1/1990 | Kobayashi | 313/471 |
| 4,908,547 | 3/1990 | Toyama et al. | 313/408 |
| 4,973,879 | 11/1990 | Fujimura | 313/403 |

FOREIGN PATENT DOCUMENTS 0025657 12/1982 Japan .

0100338 12/1983 Japan .

*Primary Examiner*—Sandra L. O'Shea
*Assistant Examiner*—Ashok Patel
*Attorney, Agent, or Firm*—Antonelli, Terry, Stout & Kraus

[57] ABSTRACT

The color cathode ray tube of this invention improves the purity (color purity) adjustment margin and permits bright display without deteriorating the resolution. At least the black matrix holes 40*g*, 40*b*, 40*r*, forming the phosphor surface or the shadow mask apertures are so arranged that the center-to-center distance between the adjacent holes or apertures corresponding to the pixel phosphors of the same color in a vertical direction is greater by about 10 to 70% than the center-to-center distance in an inclined direction. Further, at least the black matrix holes or the shadow mask apertures are shaped non-circular with their vertical cross-section greater than their horizontal cross-section. With this invention it is possible to provide a color cathode ray tube which has improved brightness and purity (color purity) adjustment margin and a substantially enhanced resolution.

8 Claims, 4 Drawing Sheets

COLOR CATHODE RAY TUBE

BACKGROUND OF THE INVENTION

The present invention relates to a color cathode ray tube and more specifically to a color cathode ray tube which has an improved purity (color purity) adjustment margin and increased brightness, without degrading resolution of display images.

A cathode ray tube of this kind includes at least a vacuum vessel consisting of a face panel, a funnel and a neck, all integrally connected together; a phosphor surface formed by applying a phosphor to the inner surface of the face panel; a shadow mask installed inside the face panel and suspended close to the phosphor surface; and an electron gun installed inside the neck. The electron gun emits, for example, three electron beams, which are color-selected by the shadow-:mask and strike the phosphor to reproduce a desired picture.

The phosphors of generally three primary colors, embedded in a specific order in black matrix holes of various shapes such as dot, stripe or rectangle, are applied to the inner side of the face panel to form the phosphor surface.

The shadow mask consists of a metal plate formed with a large number of electron beam passage apertures, each of which has a color selection function to make the electron beam hit the phosphor of an appropriate primary color on the phosphor surface.

The black matrix holes in which to embed the phosphors are generally in the form of a stripe or rectangle for so-called television color cathode ray tubes, whereas color cathode ray tubes, such as display monitors, that require precise and detailed image display, employ dot-shaped black matrix holes or those of similar shapes.

The electron beam passage apertures in the shadow mask installed inside the face panel generally have a similar shape to the phosphors. The cathode ray tube with dot-shaped phosphors (dot-shaped black matrix holes) uses a shadow mask formed with circular electron beam passage openings.

FIG. 4 is a schematic diagram showing a black matrix pattern on the phosphor surface of a conventional color cathode ray tube that has dot-shaped phosphors and circular electron beam passage apertures. Reference numeral 40*g* represents a black matrix hole in which to embed a green phosphor G, 40*b* a black matrix hole in which to install a blue phosphor B, and 40*r* a black matrix hole in which to place a red phosphor R.

As shown in the figure, the black matrix pattern formed on the conventional phosphor surface is generally arranged in such a way that the lines connecting the centers of the black matrix holes of the same color form a regular triangle, with the center-to-center distances between the adjacent colors (pitches) p being equal.

Therefore, the distance between the black matrix holes of the same color in a vertical direction V in which the beam is deflected at a relatively low deflection frequency is p, whereas the distance between the black matrix holes of the same color in a horizontal direction H in which the beam is deflected at a relatively high frequency is $\sqrt{3}\cdot p$.

As an example of conventional technique concerning the cathode ray tube of this kind, Japanese Patent Laid-Open No. 100338/1983 may be cited.

There is known a conventional art which has an increased distance (pitch) between the phosphors of the same color in the vertical direction V to enhance the landing margin of the electron beam for the terrestrial magnetism.

FIG. 5 is a schematic diagram showing a conventional phosphor surface with the vertical pitch of the black matrix pattern extended. Parts identical with those of FIG. 4 are assigned like reference numerals.

In the phosphor surface of FIG. 5, the distance b in the vertical direction V between lines connecting in the horizontal direction H the centers of the black matrix holes is set 50% greater than the center-to-center distance a between the horizontally adjacent black matrix holes, that is, b/a=1.50.

Thus, if the distance (pitch) between the adjacent black matrix holes (phosphors) of the same color is taken to be p, the distance between the vertically adjacent black matrix holes of the same color is $\sqrt{2}\cdot p$. Also, the distance between the horizontally adjacent black matrix holes (phosphors) of the same color is also $\sqrt{2}\cdot p$.

Literature that disclose the prior art cathode ray tube of this kind include Japanese Patent Laid-Open No. 25657/1982.

The above-mentioned color cathode ray tube having dot-type phosphors has many advantages over the so-called slit matrix system (Trinitron type color cathode ray tube (trade name)) in terms of adjustability of superimposition of electron beams of individual primary colors, such as enhanced convergence, which is realized by the use of a face panel having a larger spherical curvature. For luminance and purity, however, the slit matrix system is advantageous.

In the phosphor surface shown in FIG. 4, the horizontal pitch between the black matrix holes of the same color is $\sqrt{3}$ times the vertical pitch.

FIG. 6 is a diagram explaining the transmission factors of the phosphor surface of the conventional color cathode ray tube shown in FIG. 4. As shown in the figure, if the vertical distance (pitch) between the phosphors of the same color is taken to be p (=210 μm) (see FIG. 4), then the vertical distance between the vertically adjacent phosphors p/2 (=105 μm), and the distance between the horizontally adjacent phosphors is $p/\sqrt{3}$ ($=210/\sqrt{3}=120$ μm).

Then if the interval (guard band) between the horizontally adjacent phosphors Cl is 40 μm, and the diameter of the black matrix hole (diameter of the phosphors) C2 is 80 μm, then the transmission factor is $(\pi/4\times80^2)/(120\times105)\times100=39.9\%$.

The resolution Of the phosphor surface is determined by the resolution in the horizontal direction in which the pitch is wider. The smaller pitch in the vertical direction reduces the purity margin, lowering the brightness.

Therefore, when phosphor surfaces of dot type and of stripe type with the same resolution are compared, the transmission factor of the black matrix is lower for the dot type phosphors than for the stripe type phosphors. In other words, the dot-type phosphors have a problem of reduced brightness.

SUMMARY OF THE INVENTION

The object of this invention is to provide a color cathode ray tube which solves the aforementioned problems experienced with the conventional techniques and which has an improved purity (color purity) adjustment margin and a brighter image display, without deteriorating the resolution.

To achieve the above objective, the color cathode ray tube of this invention comprises:

a phosphor surface formed of two or more kinds of dot-shaped pixel phosphors;

a shadow mask; and an in-line type electron gun;

wherein at least black matrix holes forming the phosphor surface or electron beam passage apertures in the shadow mask are so arranged that the center-to-center distance between the adjacent holes or apertures corresponding to the pixel phosphors of the same color in a vertical direction is greater by a range of about 10 to 70% than the center-to-center distance between the adjacent holes or apertures corresponding to the pixel phosphors of the same color in an inclined direction; and wherein at least the black matrix holes or the shadow mask apertures are non-circular with their vertical cross-section greater than their horizontal cross=section.

Further, according to another aspect of this invention, the color cathode ray tube of the invention comprises:

a phosphor surface formed of two or more kinds of dot-shaped pixel phosphors;

a shadow mask; and an in-line type electron gun;

wherein at least black matrix holes forming the phosphor surface or electron beam passage apertures in the shadow mask are so arranged that the center-to-center distance between the adjacent holes or apertures corresponding to the pixel phosphors of the same color in a vertical direction is greater by a range of about 10 to 70% than the center-to-center distance between the adjacent holes or apertures corresponding to the pixel phosphors of the same color in an inclined direction;

wherein at least the black matrix holes or the shadow mask apertures are non-circular with their vertical cross-section greater than their horizontal cross-section; and wherein the intervals between at least the adjacent black matrix holes or adjacent electron beam passage apertures in the shadow mask measured along straight lines connecting the centers of the adjacent holes or apertures are almost equal to one another.

The electron beam passage apertures in the shadow mask are basically arranged so that lines connecting the centers of the adjacent apertures form a virtual square to make equal the vertical and horizontal center-to-center distances (pitches). If the black matrix holes and shadow mask apertures are true circles, however, the horizontal intervals between the adjacent pixel phosphors (the guard widths of the black matrix) are narrow and the vertical black matrix guard widths are wide. Therefore, the black matrix holes are formed oval or elliptical and the shape of the electron beam passage apertures in the shadow mask is determined in such a way as to make the black matrix guard widths in vertical, horizontal and diagonal directions uniform.

Interference of the electron beam with the center-to-center distance (pitch) between adjacent black matrix holes may produce moire. To prevent this, the vertical pitch is given a slight adjustment based on the above-mentioned square array and is set at a value that will minimize the moire effect.

Hence, if no moire is produced, the black matrix holes and the shadow mask apertures are arranged so that vertical distance: horizontal distance=$1:\sqrt{2}$.

To form the black matrix holes non-circular entails technical restrictions in the exposure process. Dot type phosphors are formed generally by rotary exposure and oscillatory exposure. Of these two methods, the oscillatory exposure is used to adjust the ratio of the slit width of a light source to the oscillation stroke to form the black matrix holes with a desired vertical and horizontal length ratio.

With the above construction, the dot type color cathode ray tube can be improved in brightness, purity (color purity) adjustment margin and resolution.

DESCRIPTION OF THE PREFERRED EMBODIMENTS

Embodiments of the present invention will now be described by referring to the accompanying drawings.

Figure 1:
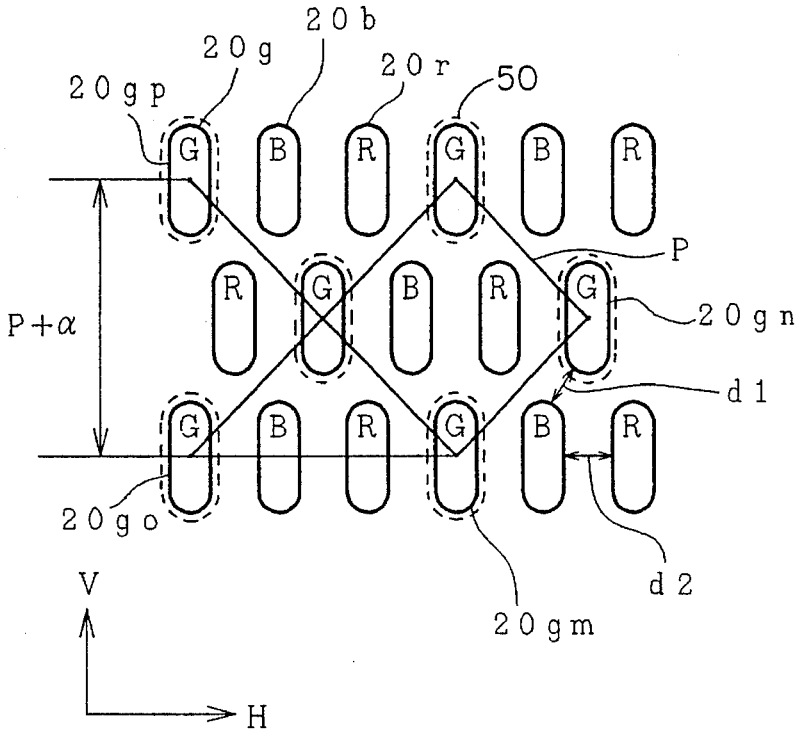
FIG. 1 is a schematic diagram showing, as one embodiment of this invention, a black matrix pattern forming a phosphor surface and electron beam passage apertures in a shadow mask of the color cathode ray tube.

FIG. 1 is a schematic diagram showing, as one embodiment of this invention, a black matrix pattern forming the phosphor surface and electron beam passage apertures in a shadow mask of a color cathode ray tube. Denoted 20*g* is a black matrix hole in which to embed a green phosphor G, 20*b* black matrix hole for a blue phosphor B, 20*r* a black matrix hole for a red phosphor R, and 50 electron beam passage apertures in a shadow mask close to the phosphor surface. Apertures 50 are provided for each black matrix hole 20, although for ease of illustration they are only depicted in FIG. 1 for the green holes 20*g*.

In the figure, of the black matrix holes 20*g*, 20*h*, 20*r* in which to put phosphors, only the holes for green phosphors are considered. Suppose that the distance between the center of a hole 20*gm* and the center of a nearest black matrix hole 20*gn* for a phosphor of the same color is taken to be p. The center-to-center distance between the black matrix hole 20*go* and a black matrix hole 20*gp*, which is adjacent to 20*go* in the vertical direction V, is set to p+a.

The black matrix holes in which phosphors of each color are embedded are formed in non-circular shapes, such as oval or rectangle, so that the intervals between adjacent black matrix holes (guard Width Of black matrix) have a relation of d1≈d2 where d1 represents an interval between adjacent holes in an inclined direction and d2 a horizontal interval.

The similar effect can also be achieved by forming the electron beam passage apertures 50 in the shadow mask in the similar shape to that of the black matrix holes or by applying the same hole arrangement to both the black matrix and the shadow mask.

Setting the value of α in the range of 10 to 70% of p improves brightness, purity (color purity) adjustment margin, and resolution.

Figure 5:
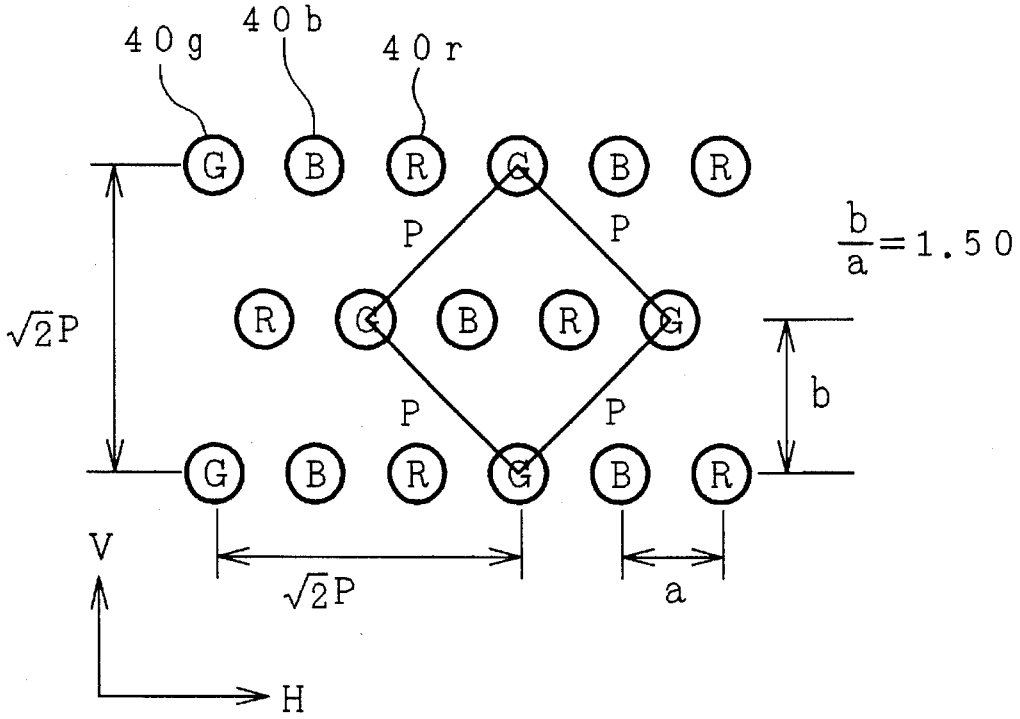
FIG. 5 (PRIOR ART)
FIG. 5 is a schematic diagram showing a phosphor surface of the prior art with the vertical pitch of the black matrix holes extended.
Figure 6:
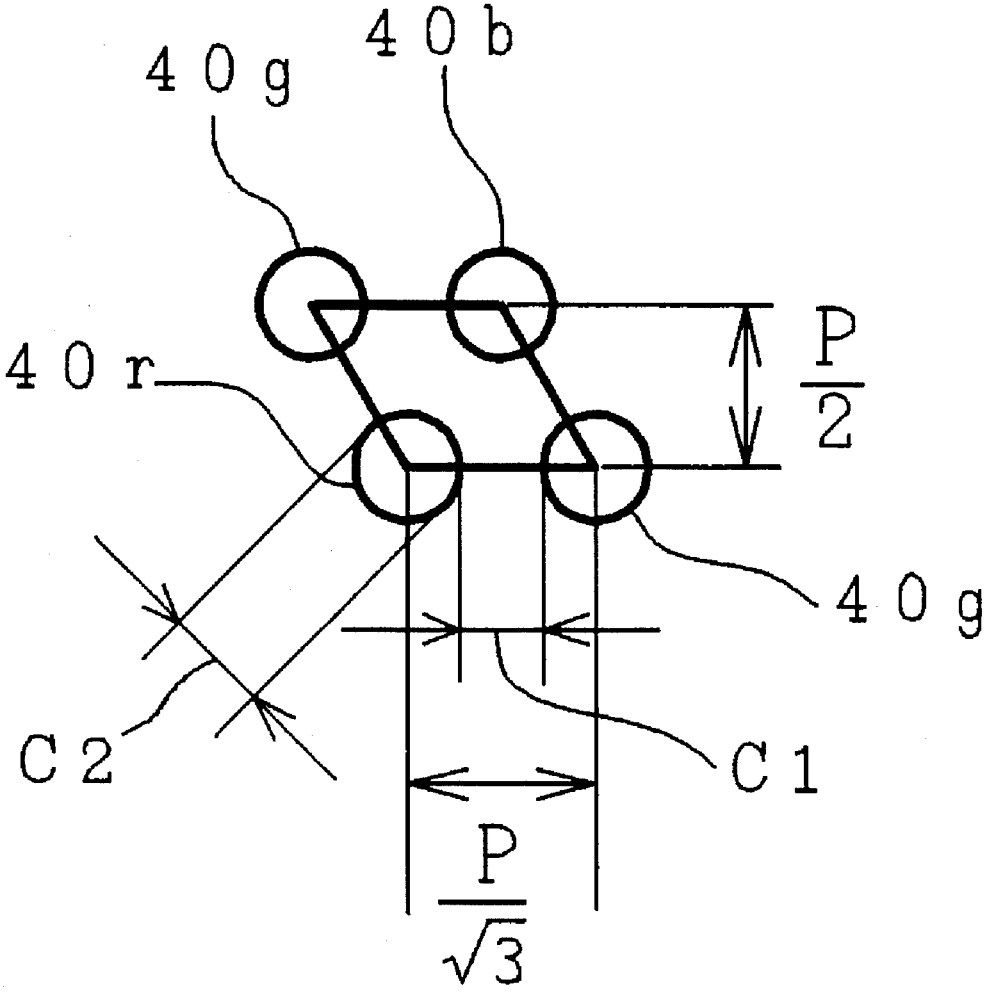
FIG. 6 (PRIOR ART)
FIG. 6 is a schematic diagram explaining the transmission factor of the phosphor surface of a conventional color cathode ray tube.

When the above-mentioned black matrix pattern was applied, for example, to a color cathode ray tube for a high-precision display monitor, which has the distance between adjacent phosphors of the same color set to p=210 μm, the brightness increased by 67% over the conventional black matrix pattern shown in FIG. 5.

Figure 4:
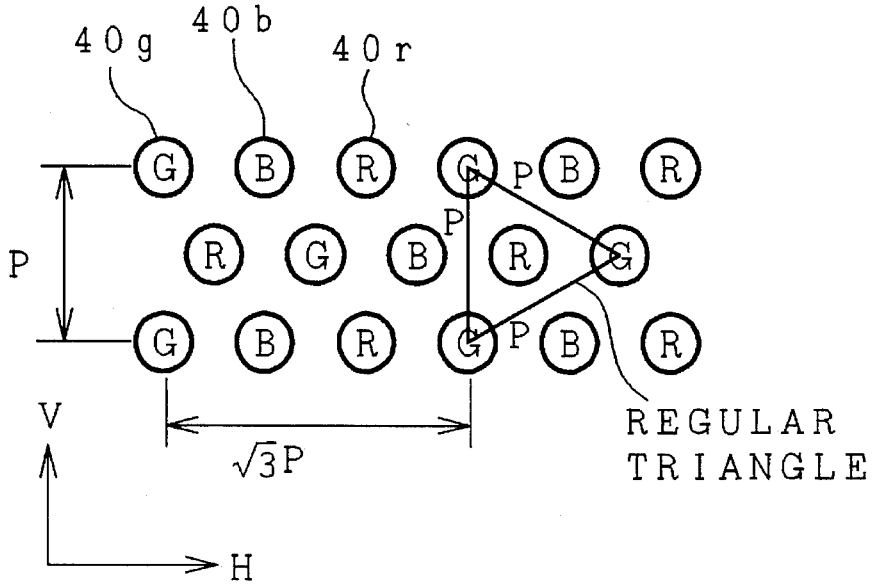
FIG. 4 (PRIOR ART)
FIG. 4 is a schematic diagram showing a black matrix pattern on the phosphor surface of a conventional color cathode ray tube having dot-type phosphors and circular electron beam passage apertures.

In a color cathode ray tube for a 20-inch display monitor having a raster size of 270 mm in the vertical phosphor surface size for the horizontal deflection frequency of 64 kHz and 50 kHz, it is found that the moire can be suppressed if the vertical distance (pitch) between black matrix holes or electron beam passage apertures in the shadow mask is set at approximately 340 μm. Further, for the horizontal pitch to be equal to the conventional one shown in FIG. 4, it is set to about 210 μm×$\sqrt{3}$=360 μm.

When the vertical pitch between the black matrix holes of the same color on the phosphor surface is set to 210 μm, which is equal to the conventional pitch, then the setting of the guard width of the black matrix holes to 40 μm results in the black matrix hole diameter of 80 μm and the transmission factor of 39.9%.

The transmission factor provided by this invention is described below.

Figure 2:
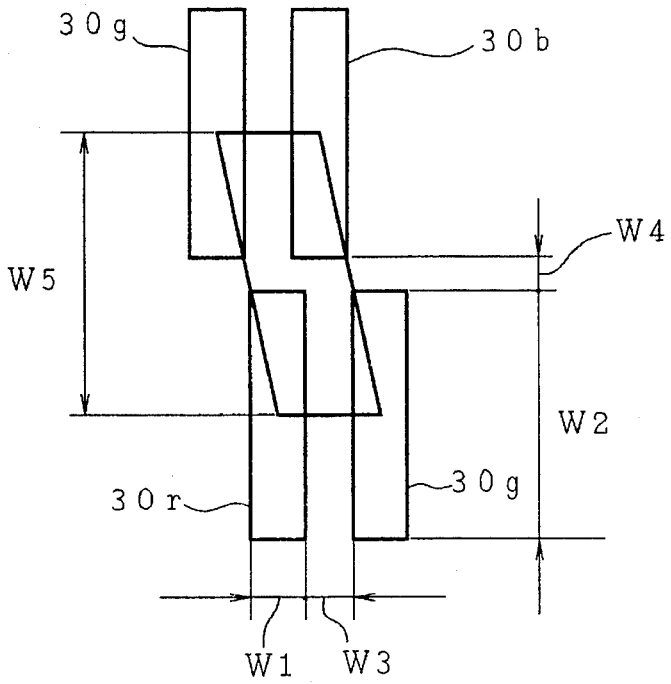
FIG. 2 is a schématic diagram showing an essential portion of the black matrix pattern on the phosphor surface as another embodiment of this invention.

FIG. 2 is a schematic diagram showing, as another embodiment, an essential portion of the black matrix pattern on the phosphor surface. Reference number 30*g*, 30*b*, 30*r* represent black matrix holes. Although not depicted in FIG. 2, electron beam passage apertures are provided for each black matrix hole, just as in the embodiment of FIG. 1.

In the figure, if the black matrix holes are formed as rectangles with the horizontal width W1 set to 80 μm, the vertical diameter W2 to 300 μm, the horizontal guard width W3 to 40 μm, the vertical guard width W4 to 40 μm and the vertical distance between adjacent holes W5 to 340 μm, this black matrix pattern provides resolution and purity equal to those of the conventional black matrix pattern and also offers the transmission factor of [(80 μm ×300 μm)/(120 μm×340 μm)]×100=58.8%.

In other words, the black matrix pattern according to this invention provides a 67% (58.8/39.9=1.47) improvement in brightness over the conventional pattern.

This invention is not limited to the above embodiments. The luminance, purity (color purity) adjustment margin and resolution can also be improved, for example, by forming at least the black matrix holes or electron beam passage apertures into non-circular shapes whose vertical cross-section is greater than their horizontal cross-section and by setting the value of α in the range of about 10 to 70% of p·. For the black matrix pattern having an α value less than 10%, almost no improvement is obtained. When the α value is far greater than 70%, reduction in the transmission factor of the electron beam and in the vertical resolution results. Hence, selection of the 10 to 70% range is a practical decision.

Figure 3:
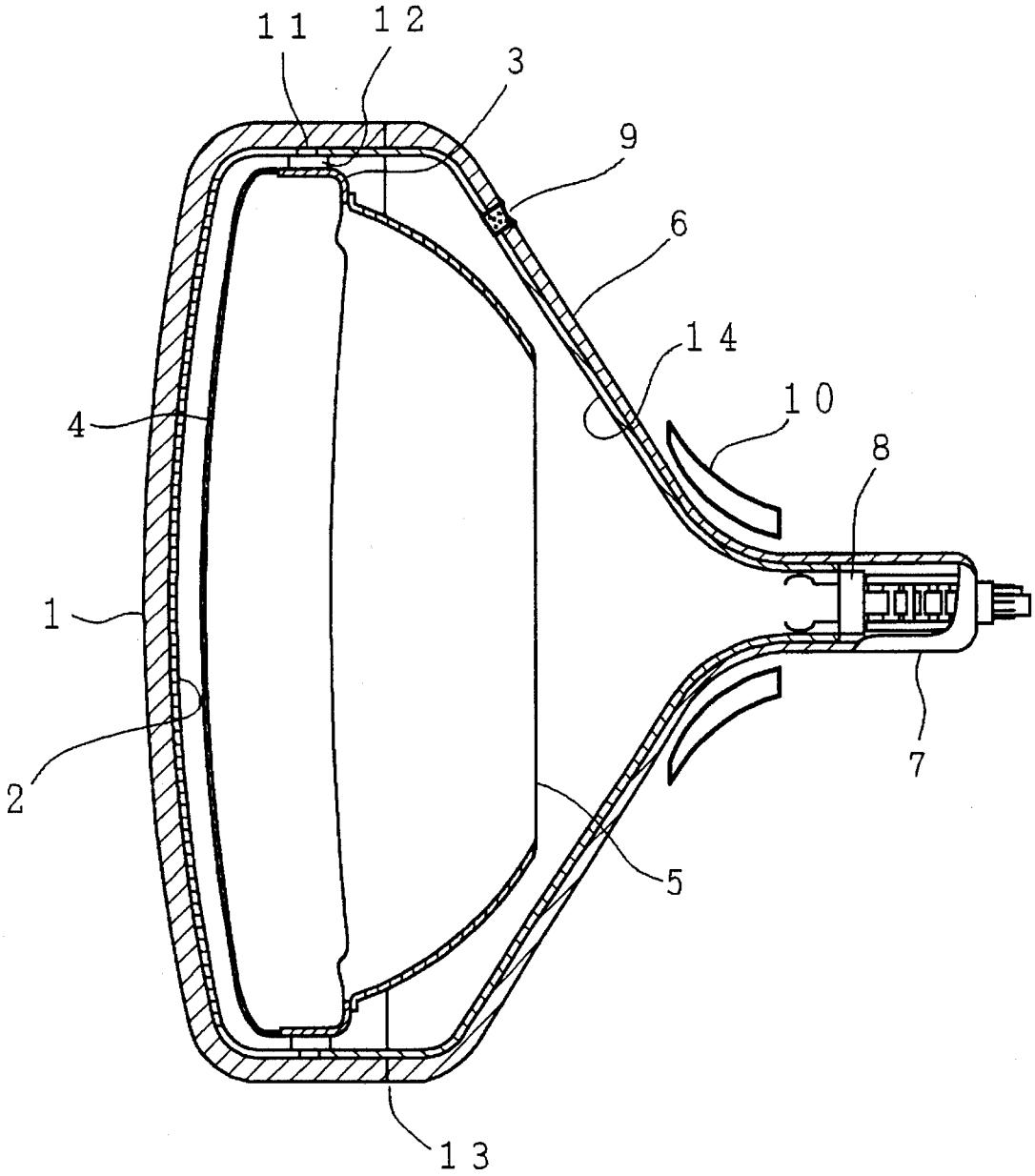
FIG. 3 is a cross section showing an overall structure of one embodiment of the color cathode ray tube according to this invention.

FIG. 3 is a cross section showing the overall construction of one embodiment of a color cathode ray tube according to this invention. Reference numeral 1 represents a face panel, 2 a phosphor surface, 3 a mask frame, 4 a shadow mask having electron beam passage apertures therein, 5 an inner magnetic shield, 6 a funnel, 7 a neck, 8 an electron gun, 9 a high-voltage application terminal, 10 a deflection yoke, 11 a panel pin, 12 a suspension spring for ! a shadow mask, 13 a frit joint, and 14 an inner conductive film.

In the figure, the inker surface of the face panel 1 is covered with a pattern of two or more kinds of pixel phosphors embedded in black matrix holes to form a phosphor surface. The mask frame 3 is mounted through the suspension spring 12 to the panel pins 11 embedded in the inner side of the face panel 1.

This mask frame 3 is securely attached with the shadow mask 4 and the inner magnetic shield 5, as by welding.

The face panel 1 and the funnel 6 are joined together at the frit joint 13 by frit glass. Installed inside the neck 7 that connects to the funnel 6 is the electron gun 8 that emits a plurality of electron beams arranged in line.

The electron beams emitted from the electron gun 8 pass through deflection fields produced by the deflection yoke 10 and are deflected in the horizontal and vertical directions, before being color-selected by the apertures the shadow mask 4. The beams then strike the phosphor surface 2 to produce a picture.

In this operation of the cathode ray tube, by arranging as mentioned above at least the black matrix holes in the phosphor surface or the electron beam passage apertures in the shadow mask, it is possible to improve the brightness, the purity (color purity) adjustment margin and the resolution of the dot-type color cathode ray tube.

As described above, this invention can provide a color cathode ray tube equipped with a dot-type phosphor surface and a shadow mask, which has improved brightness and purity (color purity) adjustment margin and a substantially enhanced resolution.

I claim:

1. A color cathode ray tube comprising:

a face panel;

a phosphor surface covering the inner surface of the face panel and having a pattern of two or more kinds of pixel phosphors embedded in black matrix holes;

a shadow mask mounted inside the face panel and close to the phosphor surface;

an electron gun for emitting a plurality of electron beams in a line; and means for deflecting the electron beams, emitted from the electron gun, horizontally and vertically, for color selection by the shadow mask such that the electron beams strike the phosphor surface to produce an image;

wherein the pixel phosphors are arranged in a pattern with the center-to-center distance between the adjacent pixel phosphors of the same color in a vertical direction greater than the center-to-center distance between the adjacent pixel phosphors of the same color in an inclined direction; and wherein the black matrix holes are non-circular with their vertical cross-section greater than their horizontal cross-section.

2. A color cathode ray tube according to claim 1, wherein the center-to-center distance between the adjacent pixel phosphors of the same color in the vertical direction is greater by about 10 to 70% than the center-to-center distance between the ajacent pixel phosphors of the same color in the inclined direction.

3. A color cathode ray tube according to claim 1, wherein adjacent black matrix holes are separated by intervals, measured along straight lines connecting the centers of the adjacent black matrix holes., which are substantially equal to one another.

4. A color cathode ray tube comprising:

a face panel;

a phosphor surface covering the inner surface of the face panel and having a pattern of two or more kinds of pixel phosphors embedded in black matrix holes;

a shadow mask mounted inside the face panel and close to the phosphor surface;

an electron gun for emitting a plurality of electron beams in a line and means for deflecting the electron beams, emitted from the electron gun, horizontally and vertically, for color selection by the shadow mask such that the electron beams strike the phosphor surface to produce an image;

wherein the shadow mask has electron beam passage apertures arranged in a pattern with the center-to-center distance between the adjacent electron beam passage apertures in a vertical direction greater than the center-to-center distance between the adjacent apertures in an inclined direction; and wherein the electron beam passage apertures in the shadow mask are non-circular with their vertical cross-section greater than their horizontal cross-section.

5. A color cathode ray tube according to claim 4, wherein the center-to-center distance between the adjacent electron beam passage apertures in the vertical direction is greater by about 10 to 70% than the center-to-center distance between the adjacent apertures in the inclined direction.

6. A color cathode ray tube comprising:

a face panel;

a phosphor surface covering the inner surface of the face panel and having a pattern of two or more kinds of pixel phosphors embedded in black matrix holes;

a shadow mask mounted inside the face panel and close to the phosphor surface;

an electron gun for emitting a plurality of electron beams in line; add means for deflecting the electron beams, emitted from the electron gun, horizontally and vertically, for color selection by,the shadow mask that the electron beams strike the phosphor surface to produce an image;

wherein the pixel phosphors are arranged in a pattern with the center-to-center distance between the adjacent pixel phosphors of the same color in a vertical direction greater than the center-to-center distance between the adjacent pixel phosphors of the same color in an inclined direction; and wherein the shadow mask has non-circular electron beam passage apertures with their vertical cross-section greater than their horizontal cross-section.

7. A color cathode ray tube comprising:

a face panel;

a phosphor surface covering the inner surface of the face panel and having a pattern of two more kinds of pixel phosphors embedded in black matrix holes;

a shadow mask mounted inside the face panel and close to the phosphor surface;

an electron gun for emitting a plurality of electron beams in a line; and means for deflecting the electron beams, emitted from the electron gun, horizontally and vertically, for color selection by the shadow mask such that the electron beams strike the phosphor surface to produce an image;

wherein the shadow mask has electron beam passage apertures arranged in a pattern with the center-to-center distance between the adjacent electron beam passage apertures in a vertical direction greater than the center-to-center distance between the adjacent apertures in an inclined direction; and wherein the black matrix holes are non-circular with their vertical cross-section greater than their horizontal cross-section.

8. A color cathode ray tube according to claim 7, wherein the adjacent black matrix holes are separated by intervals, measured along straight lines connecting the centers of the adjacent black matrix holes, which are substantially equal to one another.

* * * * *